US009643183B2

(12) United States Patent
Chang et al.

(10) Patent No.: US 9,643,183 B2
(45) Date of Patent: May 9, 2017

(54) CENTRIFUGAL CHANNEL DEVICE

(71) Applicant: DELTA ELECTRONICS, INC., Taoyuan (TW)

(72) Inventors: Chien-Chung Chang, Taoyuan (TW); Sheng-Yan Hu, Taoyuan (TW); Cheng-Hsien Lu, Taoyuan (TW)

(73) Assignee: Delta Electronics, Inc., Taoyuan (TW)

( * ) Notice: Subject to any disclaimer, the term of this patent is extended or adjusted under 35 U.S.C. 154(b) by 0 days.

(21) Appl. No.: 14/946,280

(22) Filed: Nov. 19, 2015

(65) Prior Publication Data

US 2016/0199836 A1 Jul. 14, 2016

(30) Foreign Application Priority Data

Jan. 9, 2015 (TW) ..... 104100781 A

(51) Int. Cl.
*B01L 3/00* (2006.01)

(52) U.S. Cl.
CPC ... *B01L 3/502753* (2013.01); *B01L 3/502715* (2013.01); *B01L 2200/027* (2013.01); *B01L 2200/04* (2013.01); *B01L 2200/0652* (2013.01); *B01L 2200/0689* (2013.01); *B01L 2300/041* (2013.01); *B01L 2300/0803* (2013.01); *B01L 2300/0858* (2013.01); *B01L 2300/0867* (2013.01); *B01L 2300/123* (2013.01)

(58) Field of Classification Search
CPC ..... B01L 2400/0409; B01L 3/50273
USPC ..... 422/548, 533, 506
See application file for complete search history.

(56) References Cited

U.S. PATENT DOCUMENTS 3,864,089 A * 2/1975 Tiffany ..... B04B 5/04 422/72

FOREIGN PATENT DOCUMENTS

TW I363871 5/2012
TW 201332661 A 8/2013

* cited by examiner

*Primary Examiner* — Natalia Levkovich
(74) *Attorney, Agent, or Firm* — Muncy, Geissler, Olds & Lowe, P.C.

(57) ABSTRACT

The centrifugal channel device includes a channel body, a collecting unit and a waste liquid tank. The channel body includes a first surface and a second surface relatively disposed. The channel body includes a sample inlet, a sample channel, an isolation tank, a reagent inlet, a reagent channel and a mixing channel. The sample inlet is disposed on the first surface. The sample channel is connected to the sample inlet. The isolation tank is adjacently disposed and communicates with the sample channel. The reagent inlet is disposed on the first surface. The reagent channel is connected to the reagent inlet. One end of the mixing channel is connected with the sample channel and the reagent channel. The collecting unit has an opening and an overflow hole. The opening communicates with another end of the mixing channel. The waste liquid tank communicates with the opening of the collecting unit.

19 Claims, 20 Drawing Sheets

CENTRIFUGAL CHANNEL DEVICE

CROSS REFERENCE TO RELATED APPLICATIONS

This Non-provisional application claims priority under 35 U.S.C. §119(a) on Patent Application No(s). 104100781 filed in Taiwan, Republic of China on Jan. 9, 2015, the entire contents of which are hereby incorporated by reference.

BACKGROUND OF THE INVENTION

Field of Invention

The invention is relative to a channel device, especially relative to a centrifugal channel device.

Related Art

In regard to clinical medicine or food inspection, there is plenty of demand of specific biomolecules detection. Specifically, in regard to clinical medicine, by detecting the content of various biological molecules of the human body, such as free cells in blood, urine and other body fluids, or all kinds of the content of the protein, it can be preliminarily determined whether a human organ functions well or not. In regard to food inspection, by detecting the substance in the raw food materials or products, it can be preliminarily determined whether the foods contain excessive carcinogens, pesticides, or identified whether the food is genetically modified food or not. However, before testing, a particular biomolecule or substance in the samples (e.g. aforesaid blood, urine, and raw food materials or products, etc.) must be isolated or purified to increase the concentration of a specific subject matter, and it is advantageous to subsequent detection experiments. Therefore, the process and separation of the sample become the primary objective of enhancing biomedical detection technology.

In recent years, the microfluidic technology is applied to isolation or purification substances in the sample, such as a centrifugal-based microfluidic device. The centrifugal microfluidic device isolates or purifies the substances in the sample by centrifugal force generated by rotation. However, when centrifugal microfluidic device is in operation, only few amount of the samples can be injected into it every time. Thus, it is difficult to deal with a large number of samples and to detect the substance of which the content is low from the sample. Therefore, commercial application of centrifugal microfluidic device is limited and it is generally utilized as a research tool.

In addition, the current centrifugal microfluidic device is improved by continuous injection to deal with a large number of the samples. However, as to plenty of isolated samples, only an exhausting channel is provided. So that the isolated sample is sprayed on the peripheral edge due to centrifugal force.

SUMMARY OF THE INVENTION

In view of foregoing subject, an objective of the present invention is to provide a centrifugal channel device. The centrifugal channel device utilizes the centrifugal effect and density gradient method to isolate substances with different weights or sizes. The centrifugal channel device utilizes the waste liquid tank and the collecting unit to deal with plenty of sample. It can maintain the whole centrifugal channel device clean and avoid contamination.

For achieving above objective, an objective of the present invention is to provide a centrifugal channel device. The centrifugal channel device includes a channel body, at least one collecting unit and a waste liquid tank. The channel body includes a first surface and a second surface relatively disposed. The channel body includes a sample inlet, at least one sample channel, an isolation tank, a reagent inlet, at least one reagent channel and at least one mixing channel. The sample inlet is located on the first surface. The sample channel is connected with the sample inlet. The isolation tank is located adjacent to the sample channel and communicates with the sample channel. The reagent inlet is located on the first surface. The reagent channel communicates with the reagent inlet. One end of the mixing channel is connected with the sample channel and the reagent inlet. The collecting unit includes an opening and at least one overflow hole. The opening communicates with another end of the mixing channel. The waste liquid tank communicates with the overflow hole of the collecting unit.

In one embodiment, the overflow hole of the collecting unit is located on the second surface, and the waste liquid tank communicates with second surface of the channel body.

In one embodiment, the overflow hole of the collecting unit is located at the exterior of the channel body, and the waste liquid tank communicates with the exterior of the channel body.

In one embodiment, the waste liquid tank is detachably disposed on the channel body.

In one embodiment, the waste liquid tank includes an inner sidewall and an exterior sidewall, the second surface of the channel body has at least two hooks, the top sides of the inner sidewall and the exterior sidewall respectively has a slot, and the hooks are engaged with the slots.

In one embodiment, the second surface of the channel body has at least two protrusions and formed by extending from two sides of the hooks to surround a peripheral edge of the channel body, and the hooks and the protrusions are received in the slots of the waste liquid tank.

In one embodiment, the channel body further includes two elastic elements and the two elastic elements are disposed in the two slots.

In one embodiment, the collecting unit is detachably disposed on the channel body.

In one embodiment, a cavity or an opening is disposed in the channel body and the collecting unit is received in the cavity or the opening.

In one embodiment, the channel body includes two hollow cylinders, the two hollow cylinders are respectively disposed on the peripheral edges of the sample inlet and the reagent inlet.

In one embodiment, the channel body is disc-shaped, and the waste liquid tank is a ring-shaped slot and disposed on the second surface of the channel body or disposed surroundingly on an exterior of the channel body.

In one embodiment, a part of the sample channel extends outwardly to form the isolation tank.

In one embodiment, the sample inlet is located on the geometric center of the channel body, and the sample channel extends outwardly in a spiral manner.

For achieving above objective, an objective of the present invention is to provide a centrifugal channel device. The centrifugal channel device includes a channel body, at least one collecting unit and a waste liquid tank. The channel body includes a first surface and a second surface relatively disposed. The channel body includes at least one sample channel, at least one reagent channel and at least one mixing channel. The sample channel is disposed in the channel body. The sample channel forms a sample inlet on the first surface. A part of the sample channel extends outwardly to form an isolation tank. The reagent channel is disposed within the channel body and forms a reagent inlet on the first surface. One end of the mixing channel is connected with sample channel and the reagent inlet. The collecting unit includes an opening and at least one overflow hole. The opening communicates with another end of the mixing channel. The waste liquid tank communicates with the overflow hole of the collecting unit.

For achieving above objective, an objective of the present invention is to provide a centrifugal channel device. The centrifugal channel device includes a channel body, a waste liquid tank and at least one collecting unit. The channel body includes a first surface and a second surface relatively disposed. The channel body includes a sample inlet, at least one sample channel, an isolation tank, a reagent inlet, at least one reagent channel, at least one mixing channel and at least one first connection part. The sample inlet is disposed on the first surface. The sample channel is connected with the sample inlet. The isolation tank is located adjacent to the sample channel and communicates with the sample channel. The reagent inlet is located on the first surface. The reagent channel is connected with the reagent inlet. One end of the mixing channel communicates with the sample channel and the reagent inlet. The first connection part is disposed on the second surface. The waste liquid tank is detachably disposed on the channel body. The waste liquid tank includes at least one second connection part. The first connection part and the second connection part cooperate with each other. The collecting unit includes an opening and at least one overflow hole. The opening communicates with another end of the mixing channel. The overflow hole communicates with the waste liquid tank.

In one embodiment, the first connection part is a hook and the second connection part is a slot.

In one embodiment, the waste liquid tank includes an inner sidewall and an exterior sidewall, the second surface of the channel body includes at least two hooks, the top sides of the inner sidewall and the exterior sidewall respectively includes the at least one slot, and the two hooks are engaged with the two slot.

In one embodiment, the second surface of channel body includes at least two protrusions formed by extending from two sides of the hook to surround a peripheral edge of the channel body, and each of the two hooks and each of the two protrusions are disposed together in two slots of the waste liquid tank.

In one embodiment, the channel body further includes two elastic elements disposed in the two slots.

In one embodiment, the channel body is disc-shaped, the waste liquid tank is a ring-shaped slot, and the waste liquid tank is disposed on the second surface of the channel body or disposed surroundingly on the exterior of the channel body.

In summary, the centrifugal channel device of the present invention utilizes the flow channel design, especially the configuration relationship between the sample channel and isolation tank, to filter the sample which flows through the confluence area of the sample channel and the isolation tank by the centrifugal force and density gradient solution. Thus, the lighter cells or molecular flow into the mixing channel by centrifugal force, and the heavier cells or molecular flow into the isolation tank so as to isolate substances from the sample.

Additionally, because the waste liquid tank communicates with the overflow hole of the collecting unit, the waste liquid tank can receive the excessive sample. Thus, it can easily deal with plenty of sample, maintain the while centrifugal channel device clean and avoid contamination.

BRIEF DESCRIPTION OF THE DRAWINGS

The invention will become more fully understood from the detailed description and accompanying drawings, which are given for illustration only, and thus are not limitative of the present invention, and wherein.

DETAILED DESCRIPTION OF THE INVENTION

A centrifugal channel device of a preferred embodiment of the present invention will be apparent from the following detailed description, which proceeds with reference to the accompanying drawings, wherein the same references relate to the same elements.

Figure 1:
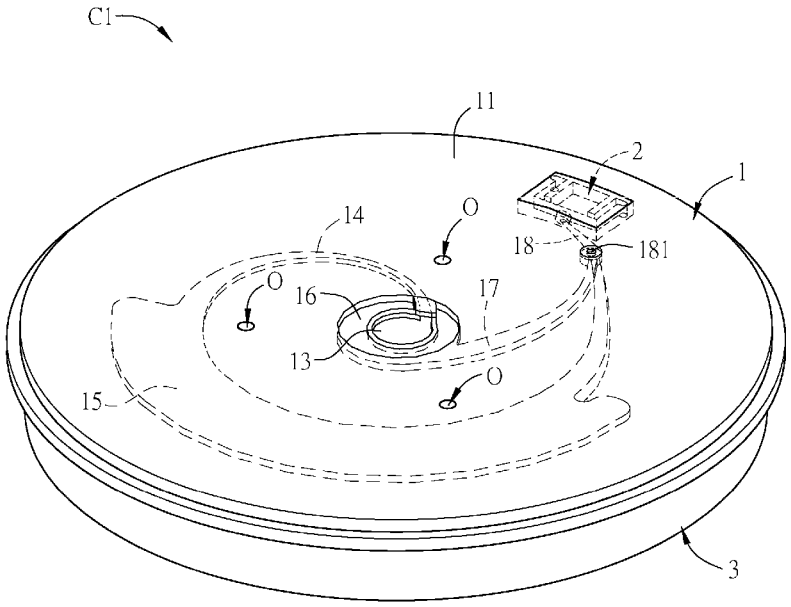
FIG. 1 is a schematic view of a centrifugal channel device according to a first embodiment of the present invention.

FIG. 1 is a schematic view of a centrifugal channel device according to a first embodiment of the present invention. Refer to FIG. 1, a centrifugal channel device C1 of the embodiment can be applied to deal with different types of samples, and the samples are fluid samples. The sample can be blood samples, biological fluids like plasma fluid, urine or other body fluids and so on. Additionally, the centrifugal channel device C1 of the embodiment can be applied to detect the sample with a low concentration target (specific biomolecule or substance). It means that there are a few content of detection targets in the sample. Thus, it is necessary to inject a lot of samples to obtain a sufficient quantity of detection targets. The centrifugal channel device C1 of the embodiment can be applied to dealing with a large number of samples.

For instance, in the process of Tumor Metastasis, the tumor cells from the primary site are transferred to other parts of the body far away from the primary site (e.g., other tissues or organs) in the continuous growth process. First, the tumor cells must cross or bypass the adjacent cells, and then enter the circulatory system, such as blood vessels. Then by the blood circulatory system, they are transferred to other tissues or organs. The free tumor cells in the blood are called "circulating tumor cells (CTC)". The content of the circulating tumor cell in the blood is low, namely, it means that the proportion of the circulating tumor cells other than blood cells to the overall composition of blood samples is very low. Even in the blood that the patient's tumor cells had metastasized, usually only one circulating tumor cells exists in every $10^6$ to $10^9$ mononuclear cells. Thus, a large amount of blood samples is required and processed to obtain a sufficient quantity of circulating tumor cells (detection target). The centrifugal channel device C1 of the embodiment is configured for isolating the circulating tumor cells from the blood sample.

Figure 2:
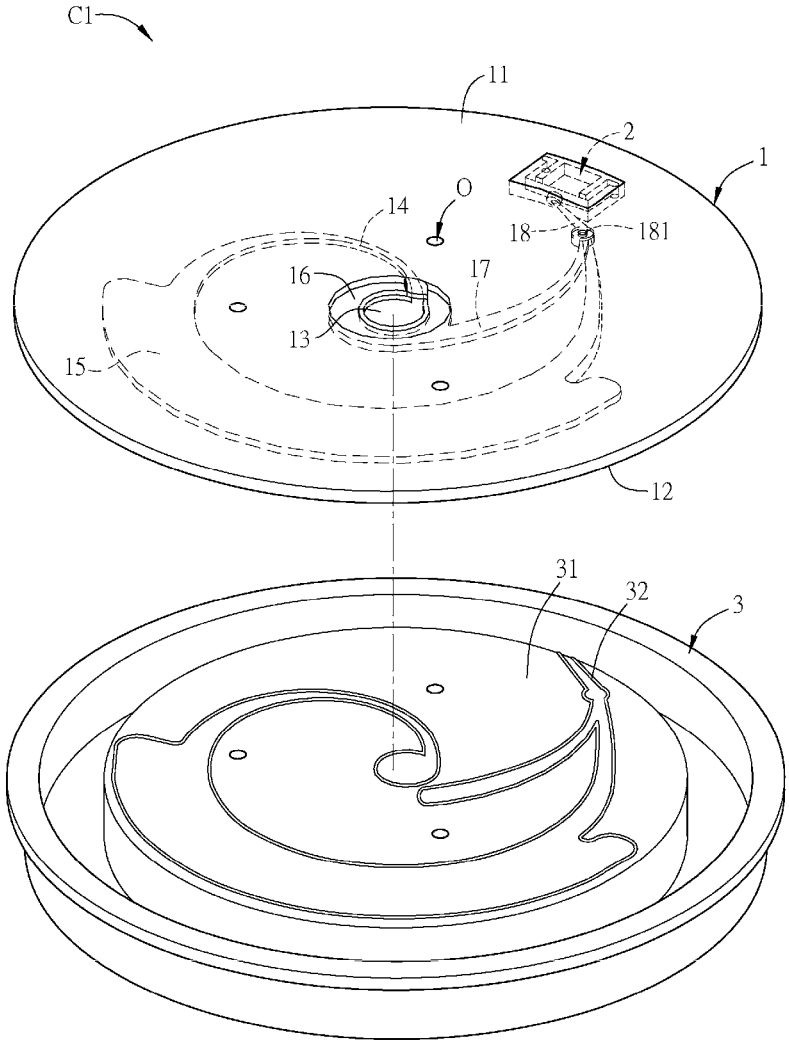
FIG. 2 is a perspective cross-sectional view of the centrifugal channel device of FIG. 1.

FIG. 2 is a perspective cross-sectional view of the centrifugal channel device of FIG. 1. Referring to FIGS. 1-2, the centrifugal channel device C1 includes a channel body 1, at least one collecting unit 2 and a waste liquid tank 3. The channel body 1 of the embodiment is dish-shaped and includes a first surface 11 and a second surface relatively disposed. Specifically, the first surface 11 can be a front side and the second surface 12 can be a rear side. It is noted that, because FIG. 2 is a perspective view, the numeral 12 is marked at the edge of the second surface 12, and it refers to the rear side of the channel body 1 (second surface 12). The channel body 1 includes a sample inlet 13, at least one sample channel 14, at least one isolation tank 15, a reagent inlet 16, at least one reagent channel 17 and a mixing channel 18. It should be noted that the quantities of the sample channel 14, the isolation tank 15, the reagent channel 17, the mixing channel 18 and the collecting unit 2 are not specifically limited. In the embodiment, one sample channel 14, one isolation tank 15, one reagent channel 17, one mixing channel 18 and one collecting unit 2 are illustrated here. In the other embodiment, there can be a plurality of the sample channels 14, the isolation tanks 15, the reagent channels 17, the mixing channels 18 and the collecting units 2. The invention does not specifically limit it.

The channel body 1 is disc-shaped, namely disc-shaped with a thickness. Thus, the sample channel 14, the isolation tank 15, the reagent channel 17 and the mixing channel 18 can be formed within the channel body 1. The sample inlet 13 and the reagent inlet 16 are located on the first surface 11 of the channel body 1. The material of the channel body 1 can be plastic, such as poly methyl methacrylate (PMMA), polycarbonate (PC) or other thermoplastics and so on.

Specifically, the sample inlet 13 is disposed at the first surface 11, namely, the first surface 11 has the sample inlet 13 in the form of opening. The sample channel 14 is formed within the channel body 1 and connected with the sample inlet 13. Preferably, the sample inlet 13 is located at the geometric center of the channel body 1, and it is beneficial to continuously inject blood samples when the centrifugal channel device C1 is in operation. It should be noted that the geometric center of the embodiment is not a central point, but the area around the geometric center. Specifically, the centrifugal channel device C1 can be utilized with a rotating platform. The centrifugal force for isolation of the content from the sample is generated by the rotation of centrifugal channel device C1 driven by the rotating platform. The centrifugal channel device C1 further includes positioning holes O which are through holes. In the embodiment, there are three positioning holes O for example. The centrifugal channel device C1 can be fixed on the rotating platform by the positioning holes O. When the centrifugal channel device C1 is driven to rotate by the rotating platform, the position of the geometric center is not changed and not deviated caused by rotation. Thus, the samples can be continuously injected into the sample inlet 13. Then the centrifugal channel device C1 can be applied to experiments or detection methods for isolation of a lot of samples. The configuration of the channel body 1 of the embodiment is not limited to those presented in the embodiment of the present invention. It should be provided with stable rotation to generate the centrifugal force. Preferably, the channel body 1 is disc-shaped.

Similarly, the reagent inlet 16 is disposed at the first surface 11, namely, the first surface 11 has the reagent inlet 16 in the form of opening. The reagent channel 17 is similarly disposed within the channel body 1 and connected with the reagent inlet 16. Preferably, the reagent inlet 16 may be located at the geometric center of the channel body 1, or the zone around the geometric center. In the embodiment, the sample inlet 13 and the reagent inlet 16 have same shapes but different dimensions. Thus, the sample inlet 13 and the reagent inlet 16 can be together located at the geometric center of the channel body 1, the sample inlet 13 is located at inner side, and the reagent inlet 16 is located at exterior side. Preferably, the sample inlet 13 and the reagent inlet 16 are circular openings, and they are located at the geometric center in a concentric manner. Thus, not only the samples, the reagents are also injected continuously. In operation, when the centrifugal channel device C1 operates, the sample such as blood sample is injected into the sample inlet 13, and the reagent is injected into the reagent inlet 16. Thus, the blood sample and the reagent are respectively imported into the sample channel 14 and the reagent channel 17 by the centrifugal force.

One end of the sample channel 14 is connected with the sample inlet 13 at the geometric center of the channel body 1 and another end extends outwardly in a spiral manner to form an arc-shaped structure surrounding the sample inlet 13. The sample channel 14 is disposed within the channel body 1. In the embodiment, an isolation tank 15 is disposed within the channel body 1. The isolation tank 15 is adjacent to the sample channel 14 and communicates with the sample channel 14. The isolation tank 15 can be same with the sample channel 14 that is the arc-shaped structure to surround the sample inlet 13. In the embodiment, the design that a part of the sample channel 14 extends outwardly can be utilized to communicate the isolation tank 15, so that the middle area of the sample channel 14 communicates with the isolation tank 15. Specifically, the whole structure of the sample channel 14 together with the isolation tank 15 presents a form of non-uniform width that its two ends is narrower and its center is wider, namely, the area adjacent to the sample inlet 13 and the mixing channel 18 is narrower and the center area is wider due to arrangement of isolation tank 15. Lighter cells in blood samples can be isolated from the isolation tank 14 and the sample channel 15. Details will be described in following paragraphs.

Similarly, the reagent channel 17 can be an arc-shaped structure to surround the reagent inlet 16. One end of mixing channel 18 of the embodiment further has a confluence point 181 connected with the sample channel 14 and the reagent channel 17. The isolated blood sample and the reagent can flow together at the confluence point and then flow into the mixing channel 18. Another end of the mixing channel 18 communicates with the collecting unit 2. Thus, the mixing solution of the blood sample and the reagent can flow into the collecting unit 2. Other details will be described in the following paragraphs.

The isolation tank 15 is utilized for receiving density gradient solutions. In the embodiment, it takes the isolation of the circulating tumor cells from the blood sample. The density gradient solution should be injected into the isolation tank 15 before injected into the blood sample. When the channel body 1 is driven to rotate, the density gradient solution forms a density gradient in the isolation tank 15 so as to sieve cells of different weights in the blood sample by the density gradient.

Figure 3:
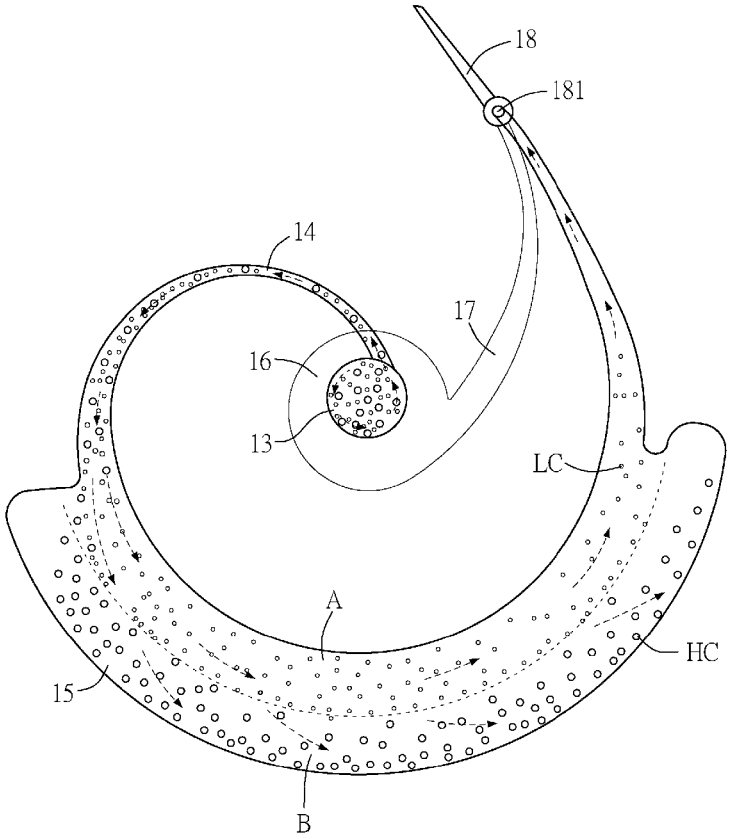
FIG. 3 is a schematic view of the centrifugal channel device of FIG. 1.

FIG. 3 is a schematic view of the centrifugal channel device of FIG. 1. Referring to FIGS. 1 and 3, at first, the density gradient is formed in the isolation tank 15 by the centrifugal force. The closer to the inner edge of the channel body 1 the area is, the lower the density is. It is therefore called "low density area A" in the embodiment. The closer to the outer edge of the channel body 1 the area is, the higher the density is. It is therefore called "high density area B" in the embodiment. It should be noted that the density gradient between the inner edge and the outer edge of the isolation tank is continuous from low to high density. In FIG. 3, it is directly divided into the low density area A and the high density area B for uncomplicated understanding. Additionally, the blood sample includes heavy cells and light cells. In the embodiment, the heavy cells are called "HC" and the light cells are called "LC". The heavy cells HL are, for example, red blood cells, white blood cells and so on. The light cells LC are, for example, circulating tumor cells and so on. When the channel body 1 is driven to rotate, the blood sample is driven by the centrifugal force to flow from the sample inlet 13 to the exterior of the channel body 1 (flowing direction is shown as the arrow). The reagent is also driven to flow from the reagent inlet 16 to the exterior of the channel body 1 and flow along the spiral (or curved) sample channel 14 and the spiral (or curved) reagent channel 17.

When the blood sample flows through the confluence area of the sample channel 14 and the isolation tank 15, the blood sample is filtered by the centrifugal force and the density gradient solution. The light cells LC or molecular are suspended in the low density area A and flow to the mixing channel 18 by the centrifugal force. The heavy cells or molecular HC flow to the high density area B. Briefly, the flow path of the blood sample is started at the sample inlet 13, and then flows along the sample channel 14. The light cells LC flow to the mixing channel 18 by the centrifugal force and the heavy cells HC are stopped at the high density area B by filtering effect resulting from the centrifugal force and the density gradient. Thus, the light cells LC and the heavy cells HC can be separated. The blood sample in the mixing channel 18 only includes light cells LC (including circulating tumor cells) and other small molecules. After the isolated blood sample flows through the mixing channel 18, the isolated blood sample flows into the collecting unit 2. Therefore, the circulating tumor cells in the blood sample are isolated and collected.

In addition, after the reagent is injected via the reagent inlet 16, the reagent flows into the reagent channel 17 and then flows into the mixing channel 18 by the centrifugation force. The reagent can be mixed with the isolated blood sample. The reagent can be a buffer solution or a solution having labeling materials for circulating tumor cells (i.e., detect a target). The solution having labeling materials for circulating tumor cells can be fluorescent dye, antibody, immuno-marker or magnetic bead. The circulating tumor cells can be labeled in the mixing channel 18 and then flow into the collecting unit 2. The circulating tumor cells can also be labeled in the collecting unit 2. Thus, detection of content of circulating tumor cells from the blood sample can be achieved.

Figure 4:
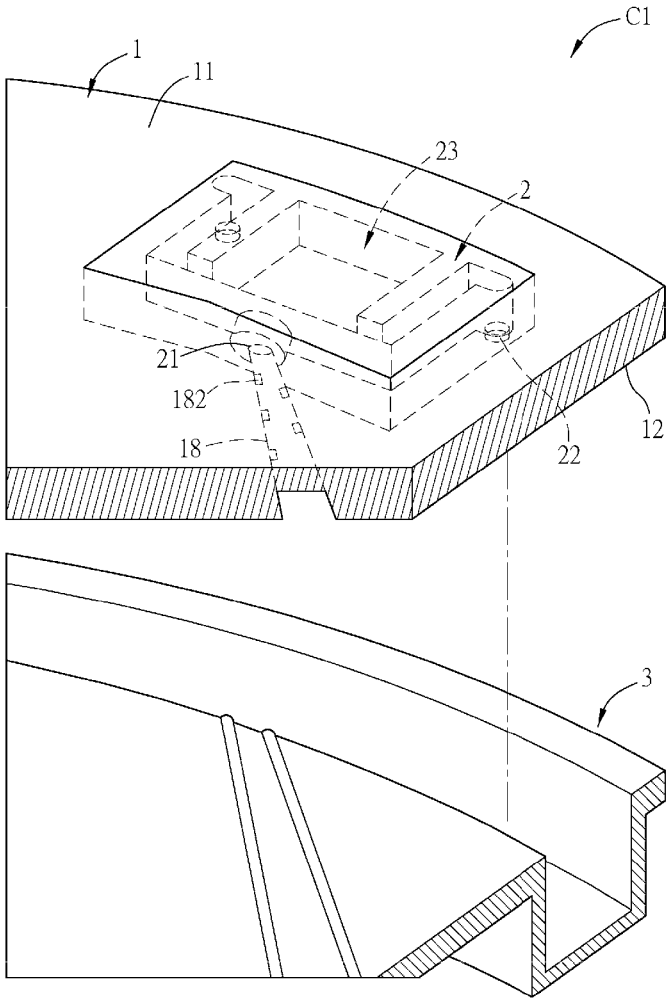
FIG. 4 is an enlarged view of the collecting unit and a part of the waste liquid tank of FIG. 2.

FIG. 4 is an enlarged view of the collecting unit and a part of the waste liquid tank of FIG. 2. As shown in FIG. 2, preferably, the mixing channel 18 can further include a plurality of micro structures 182. The micro structures 182 are discontinuously disposed within the mixing channel 18. The micro structures 182 can increase the mix degree of the reagent and the isolated blood sample for thoroughly labeling the circulating tumor cells. It is noted that, for uncomplicated drawings, the micro structures 182 is only shown in the enlarged view of the embodiment.

Referring to FIGS. 2 and 4, the collecting unit 2 of the embodiment includes an opening 21, at least one overflow hole 22 and an accommodating space 23. The opening 21 communicates with the mixing channel 18. The waste liquid tank 3 communicates with the overflow hole 22 of the collecting unit 2. The accommodating space 23 is disposed between the opening 21 and the overflow hole 22. In the embodiment, the collecting unit 2 is disposed on the peripheral edge of the disc-shaped channel body 1. The collecting unit 2 can be directly formed within the channel body 1. The overflow hole 22 of the collecting unit 2 is located on the second surface 12 of the channel body 1. Preferably, the waste liquid tank 3 is a ring-shaped slot and connected to the second surface 12 of the channel body 1, namely disposed at the bottom of the channel body 1. The waste liquid tank 3 can be directly formed on the second surface of the channel body 1 or detachably disposed on the channel body 1. It is not limited in the present invention. Thus, the opening 21 of the collecting unit 2 can receive the isolated mixing blood sample in the accommodating space 23. Users can directly move the centrifugal channel device to the observing equipment for observing the isolated mixing blood sample (including labeled circulating tumor cells). Additionally, due to a few content of circulating tumor cells in the blood, a large amount of blood sample should be injected in such kind of experiment. When the collecting unit 2 collects the excessive blood sample, the excessive blood sample may be exhausted out by the overflow 22. In addition, the waste liquid tank 3 communicating with the overflow 22 can receive the excessive blood sample in order to avoid the contamination of sprayed blood all around caused by directly exhausting the excessive blood sample out. Thus, the centrifugal channel device Cl and the corresponding experiment platform can be maintained clean.

Preferably, as shown in FIG. 2, the waste liquid tank 3 further includes a top surface 31 in the middle area. The top surface 31 has a protrusion 32 corresponding to the sample inlet 13, the sample channel 14, the isolation tank 15, the reagent channel 17 and the mixing channel 18. Additionally, the protrusion 32 can be an O-ring, for example but not limited. When the channel body 1 is assembled with the waste liquid tank 3, the design of the protrusion 32 can be utilized to prevent the liquid in the above channels from overflowing for leak-proof.

The channel body 1, the collecting unit 2 and the waste liquid tank 3 can include varieties of different implementations. Advanced descriptions are as following embodiment.

Figure 5:
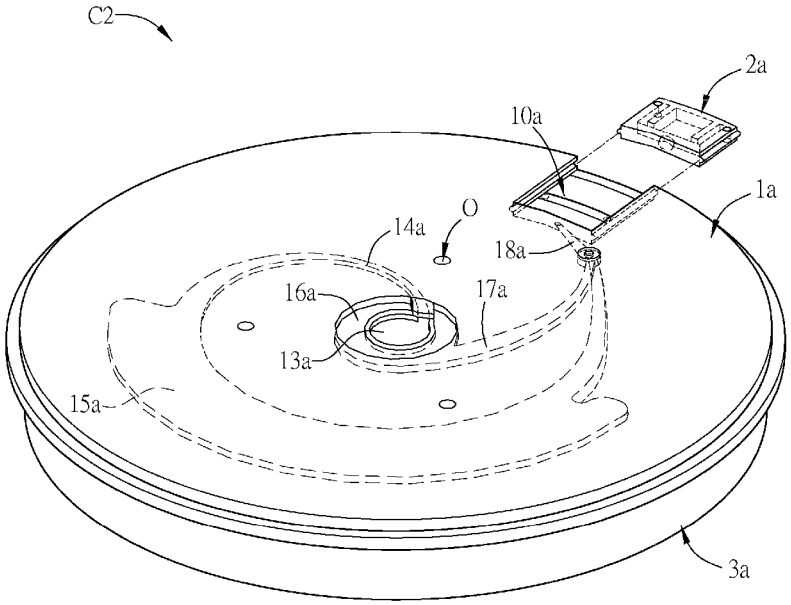
FIG. 5 is a schematic view of a centrifugal channel device according to a second embodiment of the present invention.

FIG. 5 is a schematic view of the centrifugal channel device C2 according to a second embodiment of the embodiment. Referring to FIG. 5, in the embodiment, the collecting unit 2*a* can be detachably disposed on the channel body 1*a*. The channel body 1*a* has a cavity or an opening. In the embodiment, the channel body 1*a* includes an opening 10*a*. The collecting unit 2*a* can be detachably received in the opening 10*a* (or a cavity). A long axis direction of the opening 10*a* is parallel to that of the channel body 1*a*, so that the collecting unit 2*a* can be laterally slid in the channel body 1*a*. The collecting unit 2*a* is detachable, so that the users can only take out the collecting unit 2*a* for observing. The other detail features of the centrifugal channel device C2 can be referred to the centrifugal channel device C1 in the first embodiment and they are not repeated again.

Figure 6:
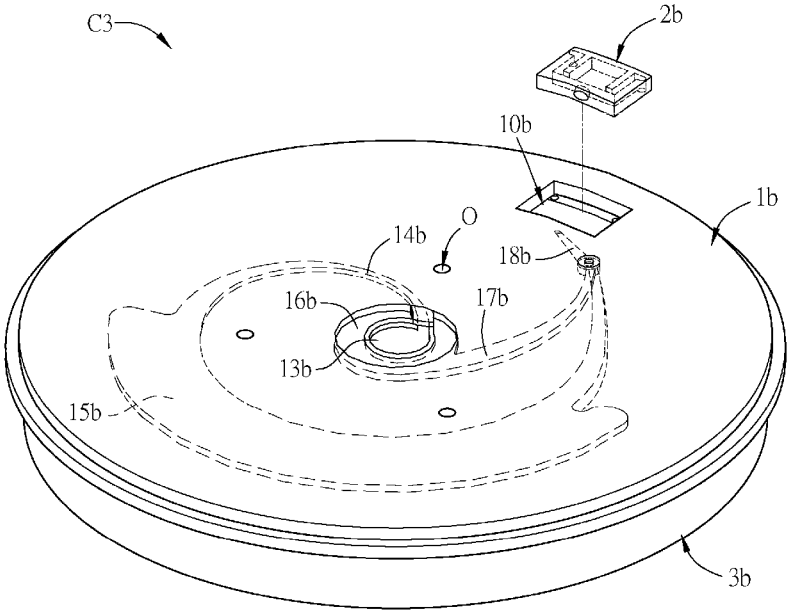
FIG. 6 is a schematic view of a centrifugal channel device according to a third embodiment of the present invention.

Additionally, FIG. 6 is a schematic view of a centrifugal channel device according to a third embodiment of the present invention. A long axis direction of the opening 10*b* is perpendicular to that of the channel body 1*a*. The collecting unit 2*a* can be directly received in the opening 10*b* from top side of the channel body 1*b*. The other detail features of the centrifugal channel device C3 can be referred to the centrifugal channel device C1 in the first embodiment and they are not repeated again.

The collecting units 2 (2*a*, 2*b*) of above embodiments are disposed in the channel body 1 (1*a*, 1*b*) in a planar manner. In the other embodiment, the collecting units 2 (2*a*, 2*b*) can be disposed in the channel body 1, 1*a*, 1*b* in a vertical manner.

Figure 7:
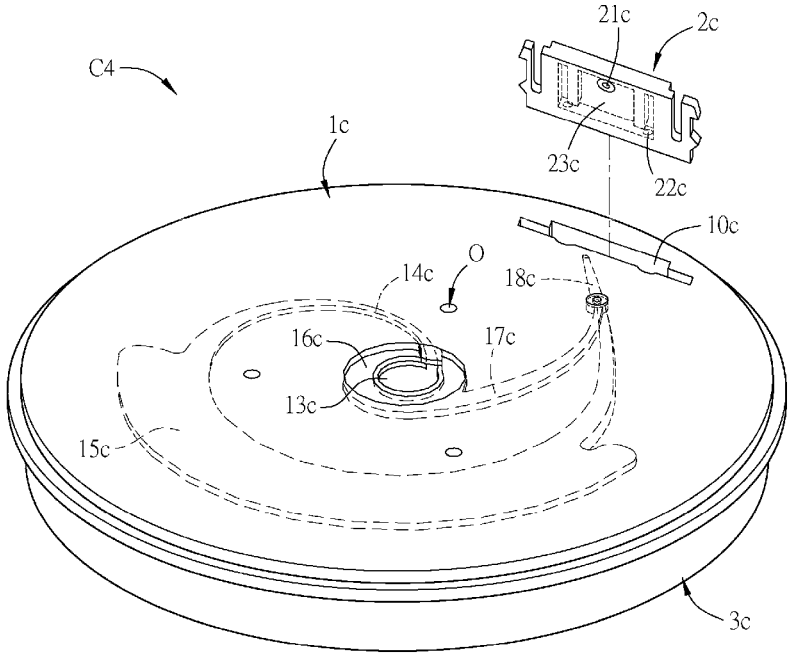
FIG. 7 is a schematic view of a centrifugal channel device according to a fourth embodiment of the present invention.

FIG. 7 is a centrifugal channel device C4 according to a fourth embodiment of the present invention. As shown in FIG. 7, the collecting unit 2*c* is disposed in the channel body 1*c* in a vertical manner. A hole 21*c* of the collecting unit 2*c* of the embodiment is disposed at the upper edge of the collecting unit 2*c*. An overflow hole 22*c* is disposed at a lower edge of the collecting unit 2*c*. The channel body 1*c* correspondingly includes an opening 10*c*. The opening 10*c* penetrates the channel body 1*c*. Thus, when the collecting unit 2*c* is received in the channel body 1*c*, the hole 21*c* at the upper edge of the collecting unit 2*c* can communicate with the mixing channel 18*c*. The overflow 22*c* directly corresponds to the waste liquid tank 3*c*, and thus the excessive blood samples can be received in the waste liquid tank 3*c*. The other detail features of the centrifugal channel device C4 can be referred to the centrifugal channel device C1 in the first embodiment and they are not repeated again.

Figure 8A:
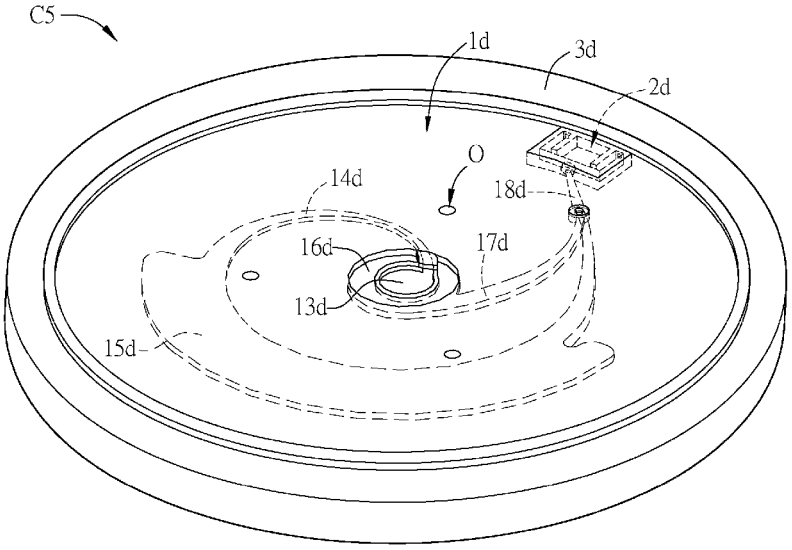
FIG. 8A is a schematic view of a centrifugal channel device according to a fifth embodiment of the present invention.
Figure 8B:
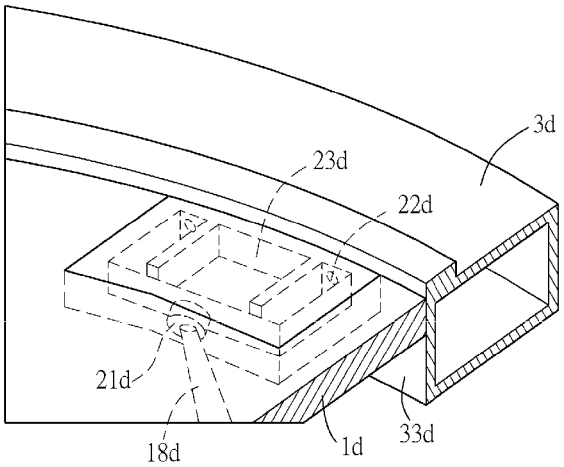
FIG. 8B is an enlarged view of the collecting unit and a part of the waste liquid tank of FIG. 8A.
Figure 8C:
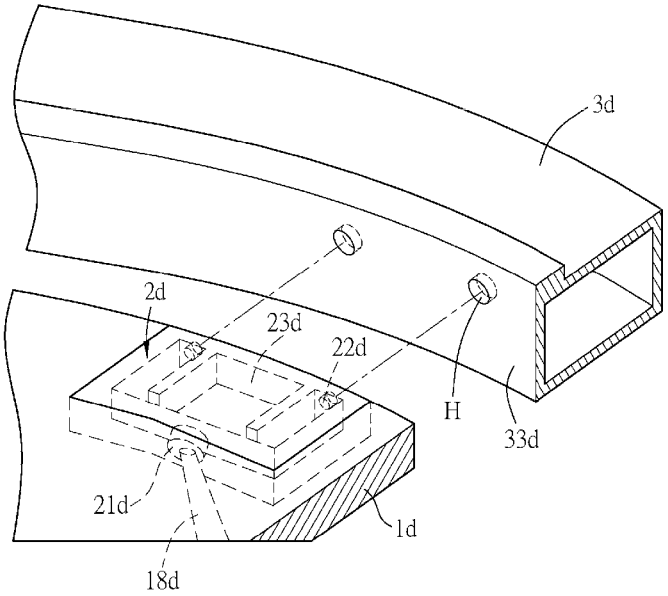
FIG. 8C is an exploded view of the collecting unit and the waste liquid tank of FIG. 8B.

FIG. 8A is a schematic view of a centrifugal channel device C5 according to a fifth embodiment of the present invention. FIG. 8B is an enlarged view of the collecting unit and a part of the waste liquid tank of FIG. 8A. FIG. 8C is an exploded view of the collecting unit and a part of the waste liquid tank of FIG. 8A. A waste liquid tank 3*d* of the embodiment is disposed surroundingly on the exterior of the channel body 1*d*. The exterior of the channel body 1*d* is represented as the exterior of a sidewall of the channel body 1*d*. As shown in FIGS. 8B and 8C, the overflow hole 22*d* of the collecting unit 2*d* is disposed at the exterior of the channel body 1*d*, namely, disposed at the sidewall of the channel body 1*d*. The inner sidewall 33*d* of the waste liquid tank 3*d* has an opening H corresponding to the overflow hole 22*d*, so that the waste liquid tank 3*d* to communicates with the exterior of the channel body 1*d*. The waste liquid tank 3*d* can be directly formed on the exterior of the channel body 1*d* or detachably disposed on the exterior of the channel body 1*d*, and it is not limited in the present invention. The overflow hole 22*d* can communicate with the waste liquid tank 3*d*. The waste liquid tank 3*d* can receive the excessive blood sample. The other detail features of the centrifugal channel device C5 can be referred to the centrifugal channel device C1 in the first embodiment and they are not repeated again.

Figure 9A:
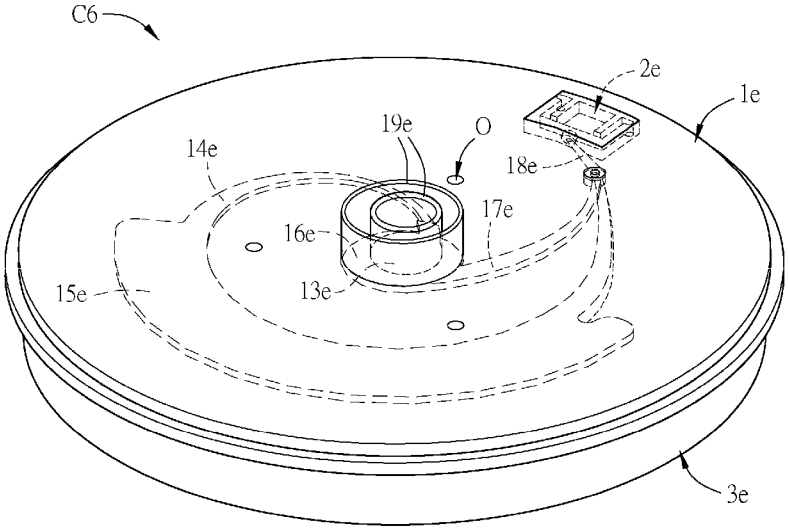
FIG. 9A is a schematic view of a centrifugal channel device according to a sixth embodiment of the present invention.
Figure 9B:
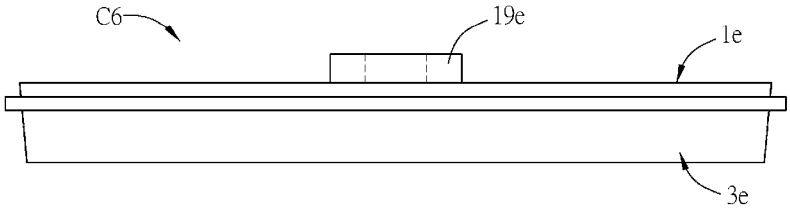
FIG. 9B is a schematic side view of the centrifugal channel device of FIG. 9A.

FIG. 9A is a schematic view of a centrifugal channel device according to a sixth embodiment of the present invention. FIG. 9B is a side view of the centrifugal channel device of FIG. 9A. A channel body 1*e* can further include two hollow cylinders 19*e*. The two hollow cylinders 19*e* are respectively disposed at an edge of a sample inlet 13*e* and an edge of a reagent inlet 16*e*. Specifically, the hollow cylinders 19*e* in the embodiment are formed by protrusions at the edge of the sample inlet 13*e* and the edge of the reagent inlet 16*e*. In the embodiment, the hollow cylinders 19*e* are configured to prevent the blood sample from contaminant caused by the reagent before the blood sample flowing into the sample channel 14*e*. The other detail features of the centrifugal channel device C6 can be referred to the centrifugal channel device C1 in the first embodiment and they are not repeated again.

Figure 10A:
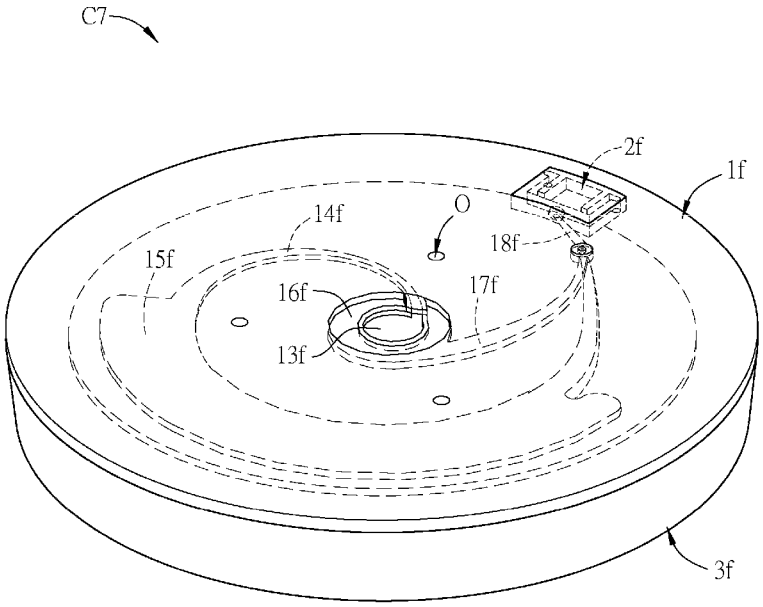
FIG. 10A is a schematic view of a centrifugal channel device according to a seventh embodiment of the present invention.
Figure 10B:
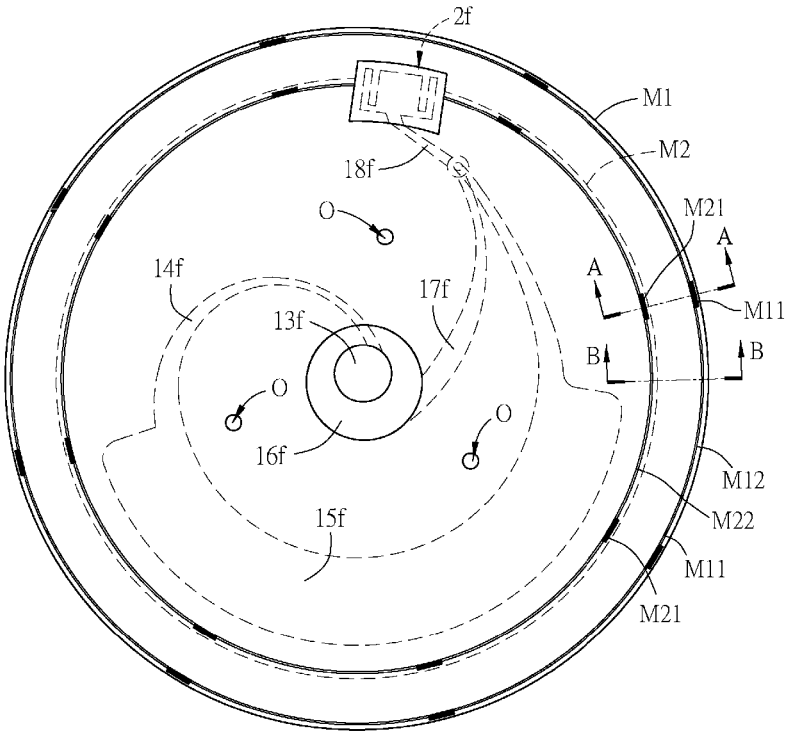
FIG. 10B is a schematic top view of the centrifugal channel device in FIG. 10A.

FIG. 10A is a schematic view of a centrifugal channel device according to a seventh embodiment of the present invention. FIG. 10B is a top view of the centrifugal channel device in FIG. 10A. A sample inlet 13*f*, a sample channel 14*f*, an isolation tank 15*f*, a reagent inlet 16*f*, a reagent channel 17*f* and a mixing channel 18*f* are disposed in the channel body 1*f*. A collecting unit 2*f* is disposed at a peripheral edge of the channel body 1*f*. A waste liquid tank 3*f* is detachably disposed in the channel body 1*f*. In the embodiment, the channel body 1*f* is stacked by two disc-shaped plastic sheets. An upper plastic sheet is called "first channel body M1", and the lower plastic sheet is called "second channel body M2". The above channels and the inlets can be disposed in the first channel body M1. The lower plastic sheet directly covers on the bottom of the second channel body M2 (referring to FIG. 11A).

Figure 11A:
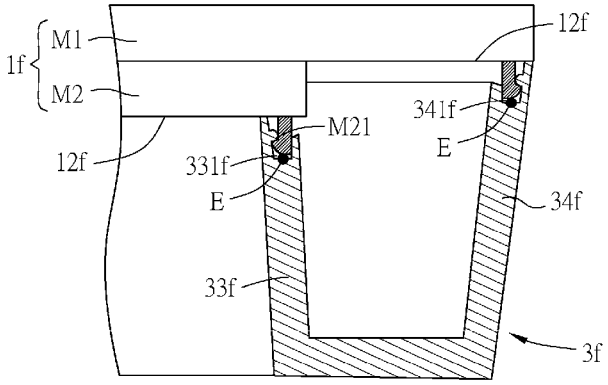
FIG. 11A is a cross-sectional view taken along line A-A of the centrifugal channel device of FIG. 10A.
Figure 11B:
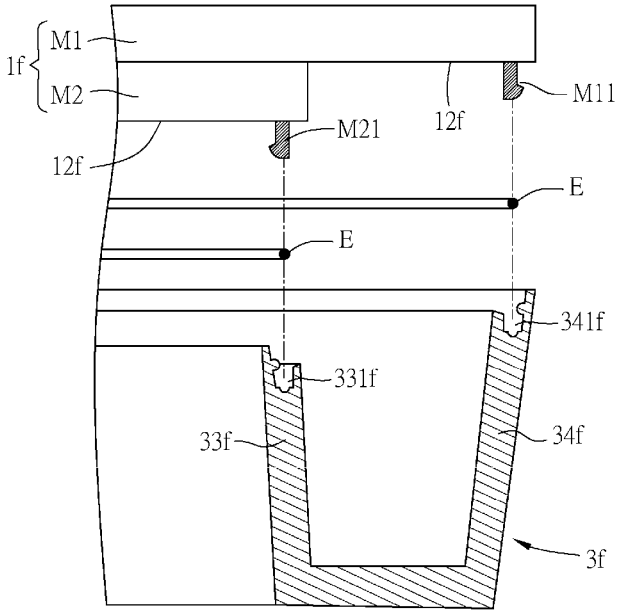
FIG. 11B is an exploded view of the centrifugal channel device of FIG. 11A.

FIG. 11A is a cross-sectional view taken along line A-A of the centrifugal channel device of FIG. 10A. FIG. 11B is an exploded view of the centrifugal channel device of FIG. 11A. A second surface 12*f* of the channel body 1*f* has at least two hooks M11, M21, namely, the hook M11 is formed on the bottom side of the first channel body M1 and the hook M21 is formed on the bottom side of the second channel body M2. The waste liquid tank 3*f* includes an inner sidewall 33*f* and exterior sidewall 34*f*. The top sides of the inner sidewall 33*f* and the exterior sidewall 34*f* respectively has a slot 331*f*, 341*f*. The hook M11 is engaged with the slot 341*f* and the hook M21 is engaged with the slot 331*f*. Thus, the waste liquid tank 3*f* can be detachably disposed in the channel body 1*f*. Different sizes of the waste liquid tanks can be chosen according to the amount of the blood sample.

Figure 12A:
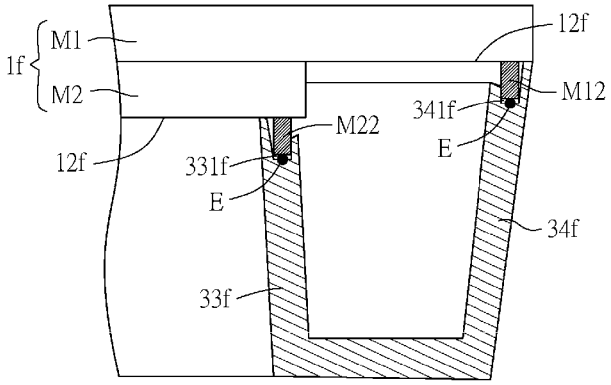
FIG. 12A is a cross-sectional view taken along line B-B of the centrifugal channel device of FIG. 10A.
Figure 12B:
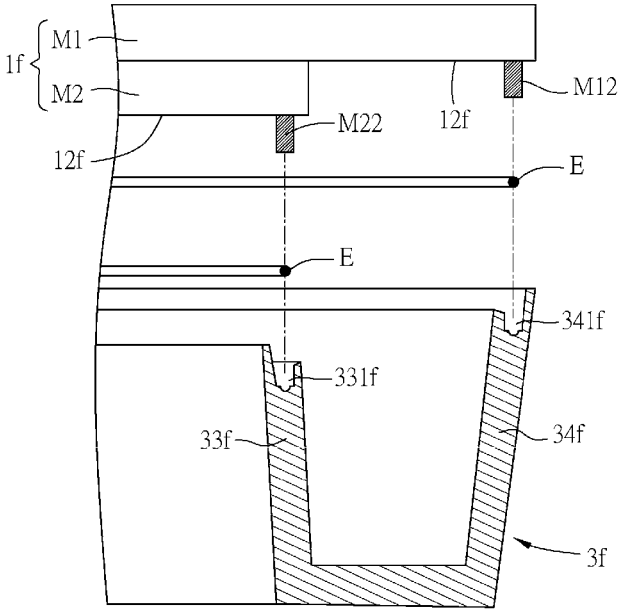
FIG. 12B is an exploded view of the centrifugal channel device of FIG. 12A.

As shown in FIG. 10B, the channel body 1*f* includes a plurality of hooks M11 (or hook M21) which are separately disposed on the channel body 1*f*. A protrusion M12 (or protrusion M22) is disposed between the two adjacent hooks M11 (or two adjacent hooks M21). In other words, the second surface of the channel body 1*f* has at least two protrusions M12, M22. The two protrusions M12, M22 are formed by extending from two sides of the hook M11, M21, so that the protrusions M12, M22 and the hooks M12, M22 are cooperatively disposed to surround the peripheral edge of the channel body 1*f*. FIG. 12A is a cross-sectional view taken along line B-B of the centrifugal channel device of FIG. 10A. FIG. 12B is an exploded view of the centrifugal channel device of FIG. 12A. The protrusions M12, M22 are similarly disposed in the slots 331*f*, 341*f* of the waste liquid tank 3*f*. Referring to FIG. 11A, the hooks M11, M21 and the protrusions M12, M22 are disposed together in the slot 331*f*, 341*f*. The configurations of the slots 331*f*, 341*f* can be varied correspondingly to the configurations of the hook M11, M21 or the protrusions M12, M22. For example, the portions of the slots 331*f*, 341*f* which correspond to the hooks M11, M21 may have protrusions for receiving hook parts of the hooks M11, M21 (as shown in FIG. 11A). The other portions of the slots 331*f*, 341*f* which correspond to the protrusions M12, M22 do not have protrusion structure. In other embodiment, the hooks M11, M21 can also surround the peripheral edge of the first channel body M1 and the second channel body M2 for enhancing the tightness of the channel body 1*f* and the waste liquid tank 3*f*.

Figure 13:
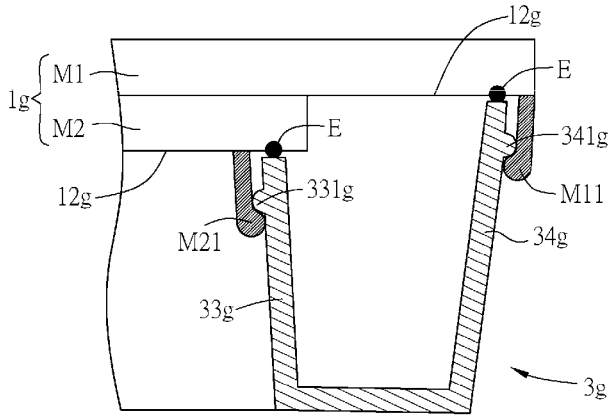
FIG. 13 a schematic diagram of another example of the connection portion of the channel body and the waste liquid tank in FIG. 11A.

In addition, referring to FIG. 13, FIG. 13 a schematic diagram of another example of the connection portion of the channel body and the waste liquid tank in FIG. 11A. In the embodiment, the first channel body M1 and the second channel body M2 also similarly include the structures of the hooks M11, M21. The hook M11 is disposed on an exterior sidewall 34*g* of the waste liquid tank 3*g* and the hook M21 is disposed on an inner sidewall 33*g* of the waste liquid tank 3*g*. Thus, the inner sidewall 33*g* and the exterior sidewall 34*g* respectively have a protrusion 331*g* and a protrusion 341*g* so that the hooks M11, M21 can be engaged with each other. Thus the waste liquid tank 3*g* and the channel body 1*g* can be fixed to each other.

Please refer to FIGS. 11A and 11B, the channel body 1*f* further includes two elastic elements E. In the embodiment, the elastic element E is an O-ring, and it may be an anti-leakage silicone gasket. The two elastic element E are disposed in the slots 331*f*, 341*f* and thus caught in between the hooks M11, M21 and the slots 331*f*, 341*f* and between the protrusions M12, M22 and the slots 331*f*, 341*f*(as shown in FIG. 12A). The channel body 1*f* can be integrated with the waste liquid tank 3*f* for leak-proof. In addition, referring to FIG. 13, in one embodiment, the elastic element E can be sandwiched between the top edges of the inner sidewall 33*g* and the exterior sidewall 34*g* and the second surface 12*g* of the first channel body M1 and the second channel body M2, and it is not limited thereto.

In addition, a centrifugal channel device is further provided in the present invention. The centrifugal channel device includes a channel body, at least one collecting unit and a waste liquid tank. The channel body includes a first surface and a second surface relatively disposed. The channel body includes a sample channel, a reagent channel and a mixing channel. The relationship of connection between the sample inlet, isolation tank, reagent inlet and other components are same as that of above embodiment, which can directly refer to the channel body 1 of the first embodiment. When the overflow hole of the collecting unit is disposed on the second surface, the waste liquid tank is connected with the second surface of the channel body (same as the first embodiment), and when the overflow hole of the collecting unit is disposed on the exterior of the channel body, the waste liquid tank is connected to the exterior of the channel body as shown in the fourth embodiment. Thus, the relationship of the collecting unit and the waste liquid tank can refer to the centrifugal channel device C4 of the fourth embodiment and they are not repeated again.

Additional centrifugal channel device is further provided in the present invention. The centrifugal channel device includes a channel body, at least one collecting unit and a waste liquid tank. The channel body includes a first surface and a second surface relatively disposed. The channel body includes a sample inlet, at least one sample channel, an isolation tank, a reagent inlet, at least one reagent channel, at least one mixing channel and at least one first connection part. The sample inlet is disposed on the first surface. The sample channel is connected with the sample inlet. The isolation tank is disposed adjacent to the sample channel and communicates with the sample channel. The reagent inlet is disposed on the first surface. The reagent channel is connected with the reagent inlet. One end of the mixing channel is connected with the sample channel and the reagent channel. The first connection part is disposed on the second surface. The waste liquid tank is detachably disposed within the channel body. The waste liquid tank includes at least one second connection part. The first connection part and the second connection part cooperate with each other. The collecting unit includes an opening and at least one overflow hole. The opening communicates with another end of the mixing channel. The overflow hole communicates with the waste liquid tank.

The sample inlet, the sample channel, the isolation tank, the reagent inlet, the reagent channel and the mixing channel can be referred to above embodiments. In the embodiment, the second surface of the channel body has a first connection part. The waste liquid tank includes a second connection part. The first connection part and the second connection part cooperate with each other, for instance, the first connection part can be a hook and the second connection part can be a slot. Thus, the first connection part and the second connection part can be referred to the centrifugal channel device C7 of the seventh embodiment. The relationship and the configuration of the other units can be referred to the centrifugal channel device C4 of the fourth embodiment and they are not repeated again.

Figure 14A:
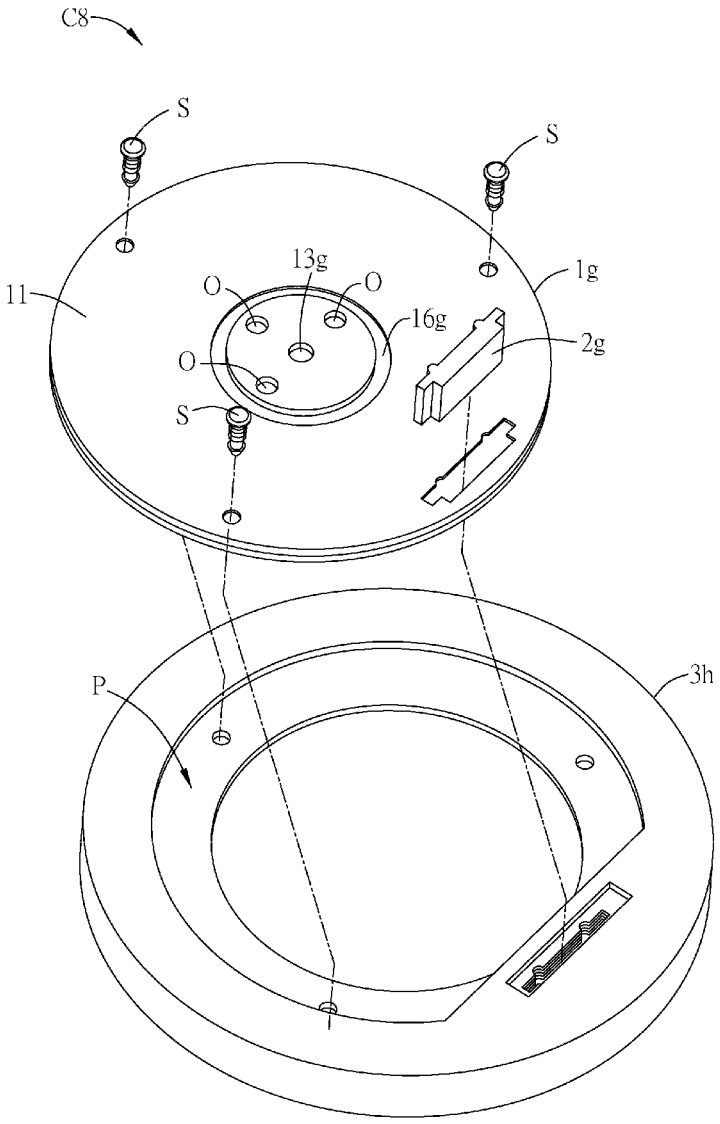
FIG. 14A and FIG. 14B are schematic views of a centrifugal channel device according to an eighth embodiment of the present invention.
Figure 14B:
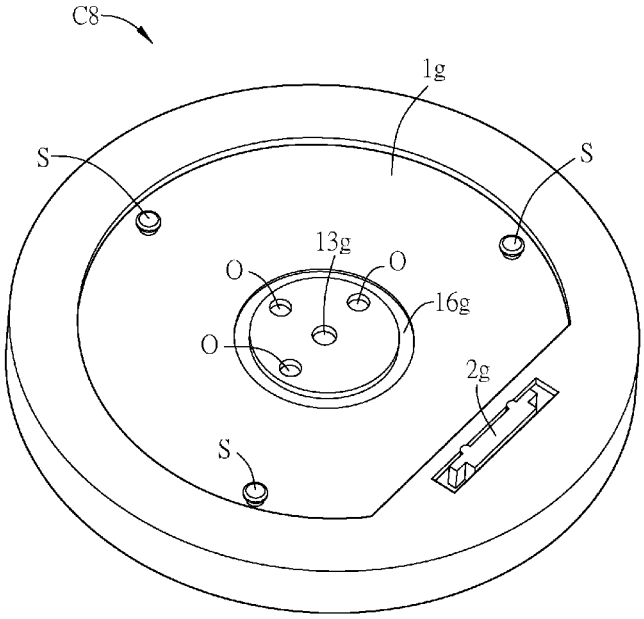

Referring to FIG. 14A and FIG. 14B, FIG. 14A and FIG. 14B are schematic views of a centrifugal channel device according to an eighth embodiment of the present invention. The centrifugal channel device C8 includes a channel body 1*g*, a collecting unit 2*g* and a waste liquid tank 3*h*. The channel body 1*g* is disposed at an accommodation space P of the waste liquid tank 3*h* for accommodating the channel body 1*g*. The channel body 1*g* is disk-shaped with enough thickness so the sample channel, the isolation tank, the reagent channel and the mixing channel can form within the channel body 1*g*. Because these channels and tank is similar to or the same with those described in the previous embodiments, they are not repeated here. The sample inlet 13*g* and the reagent inlet 16*g* are located on the first surface 11 of the channel body 1*g*.

During disposition, the channel body 1*g* (disk) is slantingly inserted to the accommodation space P of the waste liquid tank 3*h*, and then it is disposed at the waste liquid tank 3*h* by the fixing element S. The fixing element S may be for example but not limited to a screw, a pin or a nail.

The channel body 1*g* (disk) and the waste liquid tank 3*h* are disposed separately. Thus, it is possible to apply the waste liquid tank 3*h* to different channel body 1*g* (disk), and to reuse. The waste liquid tank 3*h* may be reused under acceptable capacity condition for reducing cost. Besides, if the thickness of the channel body 1*g* (disk) changes, it is still possible to apply the waste liquid tank 3*h* to the channel body 1*g* (disk) which has different thickness and different channel configuration.

The channel body 1*g* is formed by combining two disks. The above mentioned channel is recessed on one of the two disks and covered by the other disk to form the channel. Or from the sectional view of the channel, regarding the channel for constituting the sample channel, the reagent channel and the mixing channel, its one part is recessed on one of the two disks and the other part is recessed on the other one of the two disks. The two disks are attached to each other to form the channel. Because other element relationships or variations can refer to the previous embodiment, they are not repeated here.

Figure 15A:
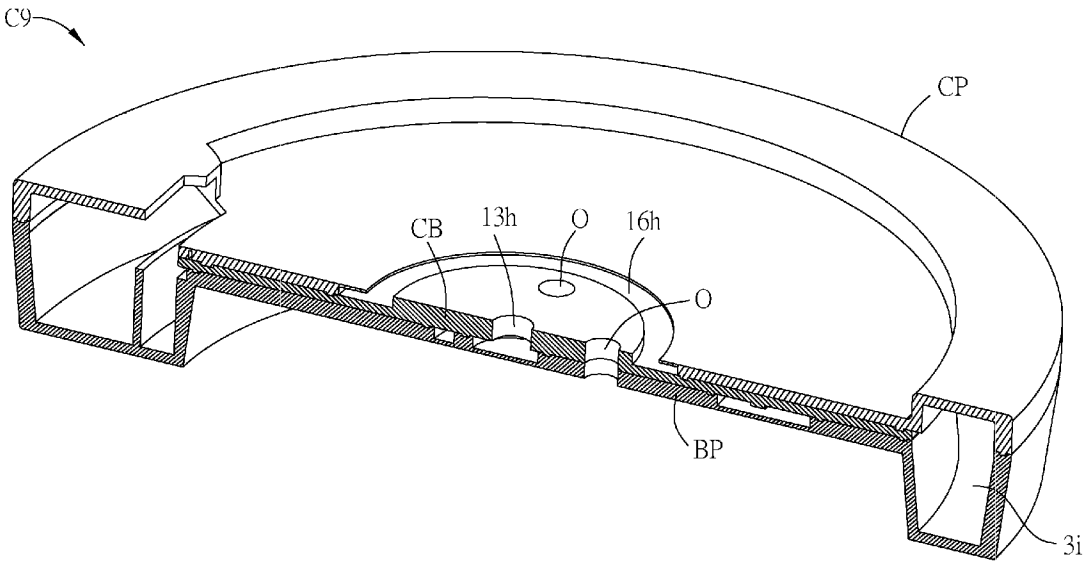
FIG. 15A and FIG. 15B are schematic views of a centrifugal channel device according to a ninth embodiment of the present invention.
Figure 15B:
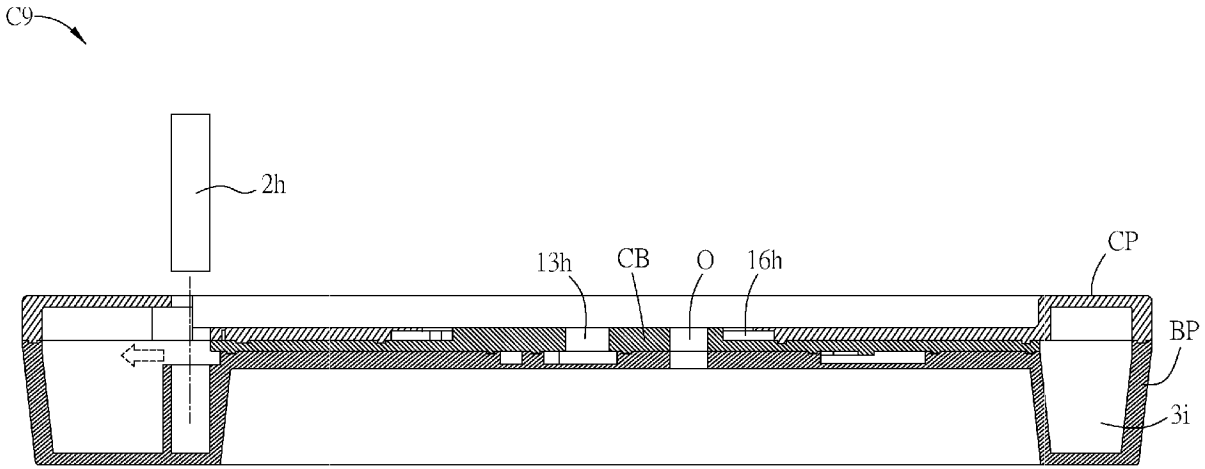
Figure 15C:
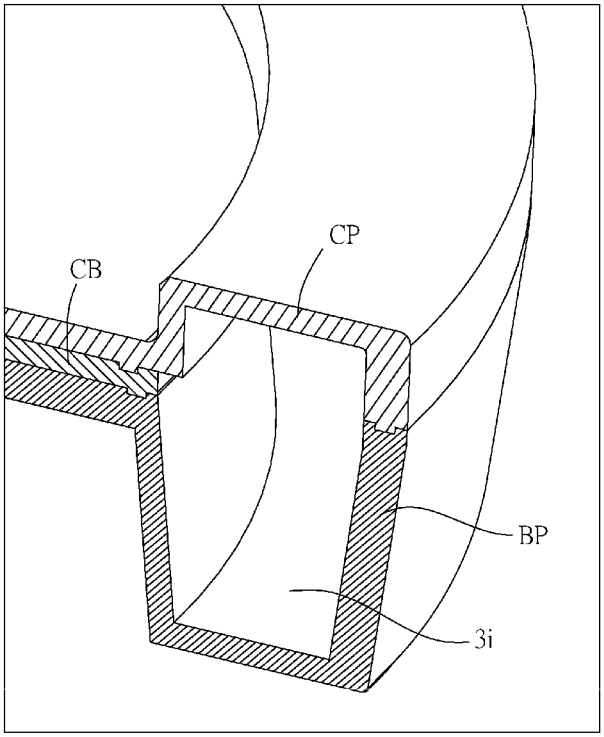
FIG. 15C is an enlarged view of the cover plate, the connection of the channel board and the bottom plate in the centrifugal channel device according to the ninth embodiment of the present invention.

FIG. 15A and FIG. 15C are schematic views of a centrifugal channel device according to a ninth embodiment of the present invention. The centrifugal channel device includes a cover plate CP, a channel board CB and a bottom plate BP and at least one collecting unit 2*h*. The channel board is sandwiched between the cover plate CP and the bottom plate BP. The waste liquid tank 3*i* is disposed at the peripheral of the bottom plate BP. The peripheral of the bottom plate BP connects to the peripheral of the cover plate CP. As shown in FIG. 15C, the cover plate CP, the channel board CB and the bottom plate BP may be connected to one another by convex-concave structure.

The channel board CB includes a sample inlet 13*h* and at least one reagent inlet 16*h*. In the embodiment, there are three reagent inlets 16*h* for example. Besides, a sample channel, at least one reagent channel and at least one mixing channel may be recessed on the channel board CB, and they are covered with the cover plate CP or the bottom plate BP to form the channel (because these channels can refer to the previous embodiment, they are not repeated here). Or from the sectional view of the channel, regarding the channel for constituting the sample channel, the reagent channel and the mixing channel, its one part is recessed on one of the channel board CB and the other part is recessed on the cover plate CP or the bottom plate BP. The channel board CB is covered with the cover plate CP or the bottom plate BP to form the channel. Because other element relationships or variations can refer to the previous embodiment, they are not repeated here.

In the embodiment, the waste liquid tank 3*i* is disposed at the bottom plate BP for reducing the cost of processing the waste liquid and avoiding pollution on system due to the waste liquid.

In summary, the centrifugal channel device of the present invention utilizes the flow channel design (especially the relationship between the sample flow channel configuration and isolation tank) to select cells in the sample by the centrifugal force and filtering of the density gradient solution when the sample is flowed through the confluence area of the sample channel and the isolation tank. Thus, the lighter cells or molecular can be flowed into the mixing channel by centrifugal force and the heaver cells can be flowed into the isolation tank for separating the substances of the sample.

Additionally, because the waste liquid tank communicates with the overflow hole of the collecting unit, the waste liquid tank can undertake the excessive sample. Thus a large number of the samples can be easily processed, and the overall clean of the centrifugal channel device can be maintained accordingly and the contamination can be avoided.

Although the invention has been described with reference to specific embodiments, this description is not meant to be construed in a limiting sense. Various modifications of the disclosed embodiments, as well as alternative embodiments, will be apparent to persons skilled in the art. It is, therefore, contemplated that the appended claims will cover all modifications that fall within the true scope of the invention.

What is claimed is:

1. A centrifugal channel device, comprising:

a channel body comprising a first surface and a second surface in opposition to the first surface, the channel body comprising:

a sample inlet located on the first surface;

at least one sample channel, connected with the sample inlet;

an isolation tank, located adjacent to the sample channel and communicating with the sample channel;

a reagent inlet, located on the first surface;

at least one reagent channel, connected with the reagent inlet; and at least one mixing channel, wherein one end of the mixing channel is connected with the sample channel and the reagent inlet;

a collecting unit, comprising an opening and at least one overflow hole, wherein the opening communicates with another end of the mixing channel; and a waste liquid tank, communicating with the overflow hole of the collecting unit, wherein the isolation tank is an arc-shaped structure to surround the sample inlet, a part of the sample channel extends outwardly to communicate the isolation tank, the whole structure of the sample channel together with the isolation tank presents a form of non-uniform width that its two ends is narrower and its center is wider.

2. The centrifugal channel device of claim 1, wherein the overflow hole of the collecting unit is located on the second surface, and the waste liquid tank communicates with second surface of the channel body.

3. The centrifugal channel device of claim 1, wherein the overflow hole of the collecting unit is located at the exterior of the channel body, and the waste liquid tank communicates with the exterior of the channel body.

4. The centrifugal channel device of claim 1, wherein the waste liquid tank is detachable with respect to the channel body.

5. The centrifugal channel device of claim 4, wherein the waste liquid tank comprises an inner sidewall and an exterior sidewall, the second surface of the channel body has at least two hooks, the top sides of the inner sidewall and the exterior sidewall respectively has a slot, and the hooks are engaged with the slots.

6. The centrifugal channel device of claim 5, wherein the second surface of the channel body has at least two protrusions formed by extending from two sides of the hook to surround a peripheral edge of the channel body, and the hooks and the protrusions are received in the slots of the waste liquid tank.

7. The centrifugal channel device of claim 5, wherein the channel body further comprises two elastic elements being disposed in the two slots.

8. The centrifugal channel device of claim 1, wherein the collecting unit is detachably disposed on the channel body.

9. The centrifugal channel device of claim 8, wherein the channel body has a cavity or an opening, and the collecting unit is received in the cavity or the opening.

10. The centrifugal channel device of claim 1, wherein the channel body comprises two hollow cylinders, respectively disposed on the peripheral edges of the sample inlet and the reagent inlet.

11. The centrifugal channel device of claim 1, wherein the channel body is disc-shaped, and the waste liquid tank is a ring-shaped slot and disposed on the second surface of the channel body or disposed surroundingly on an exterior of the channel body.

12. The centrifugal channel device of claim 1, wherein the sample inlet is located on the geometric center of the channel body, and the sample channel extends outwardly in a spiral manner.

13. A centrifugal channel device, comprising:

a channel body comprising a first surface and a second surface relatively disposed, the channel body comprising:

at least one sample channel, disposed within the channel body, wherein the sample channel forms a sample inlet on the first surface, a part of the sample channel extending outwardly to form an isolation tank; wherein the isolation tank is an arc-shaped structure to surround the sample inlet, and he whole structure of the sample channel together with the isolation tank presents a form of non-uniform width that its two ends is narrower and its center is wider;

at least one reagent channel disposed within the channel body and forms a reagent inlet on the first surface; and at least one mixing channel, wherein one end of the mixing channel is connected with the sample channel and the reagent channel;

at least one collecting unit comprising an opening and at least one overflow hole, wherein the opening communicates with another end of the mixing channel; and a waste liquid tank, communicating with the overflow hole of the collecting unit.

14. A centrifugal channel device, comprising:

a channel body comprising a first surface and a second surface in opposition to the first surface, the channel body comprising:

a sample inlet, located on the first surface;

at least one sample channel, connected with the sample inlet;

an isolation tank, located adjacent to the sample channel and communicating with the sample channel;

a reagent inlet, located on the first surface;

at least one reagent channel, connected with the reagent inlet;

at least one mixing channel, wherein one end of the mixing channel communicates with sample channel and the reagent channel; and at least one first connection part, disposed on the second surface;

a waste liquid tank, detachable with respect to the channel body, wherein the waste liquid tank comprises at least one second connection part, the first connection part and the second connection part cooperate with each other; and at least one collecting unit, comprising an opening and at least one overflow hole, wherein the opening communicates with another end of the mixing channel, and the overflow hole communicates with the waste liquid tank, wherein the isolation tank is an arc-shaped structure to surround the sample inlet, a part of the sample channel extends outwardly to communicate the isolation tank, the whole structure of the sample channel together with the isolation tank presents a form of non-uniform width that its two ends is narrower and its center is wider.

15. The centrifugal channel device of claim 14, wherein the first connection part is a hook and the second connection part is a slot.

16. The centrifugal channel device of claim 15, wherein the waste liquid tank comprises an inner sidewall and an exterior sidewall, the second surface of the channel body comprises the at least two hooks, the top sides of the inner sidewall and the exterior sidewall respectively comprises the at least one slot, and the two hooks are engaged with the two slot.

17. The centrifugal channel device of claim 16, wherein the second surface of the channel body comprises at least two protrusions formed by extending from two sides of the hook to surround a peripheral edge of the channel body, and each of the two hooks and each of the two protrusions are disposed together in the two slots of the waste liquid tank.

18. The centrifugal channel device of claim 15, wherein the channel body further comprises two elastic elements disposed in the two slots.

19. The centrifugal channel device of claim 14, wherein the channel body is disc-shaped, the waste liquid tank is a ring-shaped slot, and the waste liquid tank is disposed on the second surface of the channel body or disposed surroundingly on the exterior of the channel body.

* * * * *